US007654289B2

(12) United States Patent
Barrett

(10) Patent No.: US 7,654,289 B2
(45) Date of Patent: Feb. 2, 2010

(54) WARP-TIED FORMING FABRIC WITH SELECTIVE WARP PAIR ORDERING

(75) Inventor: Rex Barrett, Neenah, WI (US)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 12/182,307

(22) Filed: Jul. 30, 2008

(65) Prior Publication Data

US 2009/0050231 A1 Feb. 26, 2009

Related U.S. Application Data

(60) Provisional application No. 60/952,637, filed on Jul. 30, 2007.

(51) Int. Cl.
*D03D 3/04* (2006.01)
*D21F 7/08* (2006.01)
*D03D 25/00* (2006.01)

(52) U.S. Cl. ..... 139/383 A; 139/383 R; 139/414; 162/358.2

(58) Field of Classification Search ..... 139/383 R, 139/383 A, 383 AA, 408, 411, 412, 413, 139/414; 162/348, 358.1, 358.2, 900, 902, 162/903, 904
See application file for complete search history.

(56) References Cited

U.S. PATENT DOCUMENTS 4,041,989 A * 8/1977 Johansson et al. ..... 139/425 A
4,359,069 A * 11/1982 Hahn ..... 139/425 A
4,501,303 A 2/1985 Osterberg
4,564,051 A 1/1986 Odenthal
4,564,052 A 1/1986 Borel
4,605,585 A * 8/1986 Johansson ..... 442/2
4,705,601 A 11/1987 Chiu
4,729,412 A 3/1988 Bugge
4,821,780 A 4/1989 Tate
5,054,525 A 10/1991 Vohringer
5,152,326 A 10/1992 Vohringer
5,219,004 A 6/1993 Chiu
5,379,808 A * 1/1995 Chiu ..... 139/383 A
5,454,405 A 10/1995 Hawes
5,826,627 A 10/1998 Seabrook et al.

(Continued)

FOREIGN PATENT DOCUMENTS

EP 1195462 4/2002

(Continued)

*Primary Examiner*—Bobby H Muromoto, Jr.
(74) *Attorney, Agent, or Firm*—Volpe and Koenig, P.C.

(57) ABSTRACT

A double layer forming fabric for a papermaking machine is warp-tied, all the warp yarns comprising binder pairs which forming a single combined path in the paper side surface. The pair members exchange positions at an exchange point between successive path segments and are laterally displaced in relation to each other at and between each exchange point. For each successive pair, an order of insertion of the first and second members in relation to each other into the weave is inverted in relation to the order of insertion for members of the immediately preceding pair, such that each first member is adjacent to the first member of the adjacent pair at the closest exchange point, and each second member is adjacent to the second member of the adjacent pair at the closest exchange point. The fabric has improved drainage uniformity leading to improved paper formation and reduced sheet marking.

23 Claims, 13 Drawing Sheets

U.S. PATENT DOCUMENTS

| | | | | |
|---|---|---|---|---|
| 5,881,764 | A * | 3/1999 | Ward | 139/383 A |
| 6,123,116 | A * | 9/2000 | Ward et al. | 139/383 A |
| 6,202,705 | B1 | 3/2001 | Johnson et al. | |
| 6,223,780 | B1 | 5/2001 | Kaldenhoff | |
| 6,253,796 | B1 | 7/2001 | Wilson et al. | |
| 6,834,684 | B2 * | 12/2004 | Martin et al. | 139/383 A |
| 6,837,277 | B2 * | 1/2005 | Troughton et al. | 139/383 A |
| 6,854,488 | B2 * | 2/2005 | Hay et al. | 139/383 A |
| 6,896,009 | B2 | 5/2005 | Ward | |
| 6,953,065 | B2 * | 10/2005 | Martin et al. | 139/383 A |
| 6,978,809 | B2 * | 12/2005 | Quigley | 139/383 A |
| 7,048,012 | B2 | 5/2006 | Martin et al. | |
| 7,048,829 | B2 | 5/2006 | Heger et al. | |
| 7,426,944 | B2 * | 9/2008 | Danby et al. | 139/383 A |
| 2003/0217782 | A1 | 11/2003 | Nagura et al. | |
| 2004/0182465 | A1 * | 9/2004 | Ward | 139/383 A |
| 2006/0162804 | A1 * | 7/2006 | Heger et al. | 139/383 A |
| 2006/0249220 | A1 * | 11/2006 | Barrett et al. | 139/383 A |
| 2008/0035230 | A1 * | 2/2008 | Danby et al. | 139/383 A |

FOREIGN PATENT DOCUMENTS

| | | |
|---|---|---|
| WO | 2006034576 | 4/2006 |

* cited by examiner

PRIOR ART

PRIOR ART

400

600

PRIOR ART

PRIOR ART

250

150

120

WARP-TIED FORMING FABRIC WITH SELECTIVE WARP PAIR ORDERING

CROSS-REFERENCE TO RELATED APPLICATIONS

This application claims priority from Application No. 60/952,637, filed on Jul. 30, 2007, which is incorporated herein in its entirety.

FIELD OF THE INVENTION

The present invention relates to papermakers' forming fabrics, and in particular to double layer forming fabrics in which the warp yarns are arranged as binder pairs which occupy a significant percentage of a centre plane of the fabric, and the members of each successive pair are inserted into the weave in an inverted order from the immediately preceding pair.

BACKGROUND OF THE INVENTION

As used herein, the term "double layer forming fabric" refers to forming fabrics comprising two sets of yarns oriented in a first direction, one set located on the paper side and the other set located on the machine side of the fabric, and which are bound together by a single set of binder yarns oriented in a transverse direction and woven as pairs. In the fabrics of this invention, the binder yarns are warp yarns.

The term "binder yarn" refers to a yarn which occupies a path in the paper side layer and which separately interlaces with a machine side layer yarn to occupy a path in the machine side layer. The corresponding term "pair of binder yarns" refers to two binder yarns which together occupy a single combined unbroken warp path in the paper side of the fabric, such that when one member of a pair passes from the paper side layer to the machine side layer, the second member of the pair exchanges position with the first member by passing from the machine side layer to the paper side layer, thus completing the weave pattern while binding the two layers together.

The term "drainage area", expressed as a percentage of the area of the fabric weave pattern repeat, refers to the proportion of that area not occupied by the yarns, both warp and weft, used in weaving the fabric at a given substantially planar location within the fabric substantially parallel to the paper side surface and to the machine side surface of the forming fabric. The method of calculation of the drainage area at a particular location is discussed further below.

The term "float" refers to that portion of a component yarn which passes over a group of other yarns in the fabric without interweaving or interlacing with them; the associated term "float length" refers to the length of a float, expressed as a number indicating the number of yarns passed over. A float length can be expressed in terms of numbers of paper side layer or machine side layer warp or weft yarns.

The term "internal float" refers to that portion of a component yarn which passes between two sets of yarns; the associated term "internal float length" in relation to this invention refers to the length of an internal float, expressed as a number indicating the number of PS yarns passed under.

The term "inverted" means that the interweaving pattern of the pair members of a first MD yarn pair is reordered so as to be opposite to the interweaving pattern of an immediately adjacent MD yarn pair. This is effected by changing the order of insertion of the first and second members of a yarn pair in relation to an order of insertion into the overall repeating weave pattern of the first and second members of an immediately preceding pair, so that the direction of one warp yarn exchange is opposed to that occurring in the next closest exchange for the adjacent pair.

The term "machine direction", or "MD" refers to a line parallel to the direction of travel of the forming fabric when in use on the papermaking machine. The term "cross machine direction" or "CD" refers to a direction substantially perpendicular to the machine direction within the plane of the fabric. In the fabrics of the invention, the binder warp yarns are woven in the MD.

The term "paper side layer" refers to the layer in the forming fabric onto which the stock is delivered from the head box slice. The term "machine side layer" refers to the layer in the forming fabric in contact with the support means in the papermaking machine. Thus each of these layers has a paper side ("PS") surface and a machine side ("MS") surface. In the double layer fabrics of the invention, the machine side surface of the paper side layer is adjacent to the paper side surface of the machine side layer.

The term "segment" refers to a portion of the single path occupied by a specific binder yarn in one repeat of the overall weave pattern, and the associated term "segment length" refers to the length of a particular segment, and is expressed as the number of paper side layer yarns with which a member of a pair of binder yarns interweaves within the segment.

In the papermaking process, a very dilute slurry of about 99% water and 1% papermaking fibers is ejected at a very high speed and precision from a headbox slice onto a moving forming fabric, which is used to retain and support the papermaking fibres in the stock, to allow water to drain from the stock so that an embryonic fibrous web may form and to convey that web to subsequent areas of the papermaking machine.

To overcome the known disadvantages of single layer fabrics for use in the forming section, double layer forming fabrics have been developed which consist essentially of two layers: these are a paper side layer which provides the surface on which an incipient paper web is formed, and a machine side layer which provides the surface that is in contact with the static supporting surfaces of the paper making machine. As noted above, within the overall forming fabric weave pattern, either warp yarns or weft yarns can be used as binder yarns which serve to hold the layers of the double layer fabric together and may contribute to the structure of one of the layers, but in the fabrics of the invention the binder yarns are warp yarns.

It then follows that although the layers are bound together by the weaving process into a single fabric with a single overall repeating weave pattern, each of the layers is often constructed quite differently in terms of yarn sizes, yarn cross sectional shapes, yarn count (in terms of numbers of yarns per unit length), yarn fill (expressed as a percentage of the amount of yarns and their size relative to the total space available to accommodate them) and the thermoplastic polymer used in the yarns. Thus, at least the water handling capabilities, the wear resistance capabilities, and the strength capabilities of each layer, when considered separately, can be and commonly are quite different.

Modern forming fabrics are woven so as to provide a paper side layer which imparts, amongst other things, a minimum of fabric mark to, and provides adequate drainage of liquid from, the incipient paper web. The paper side layer should also provide maximum support for the fibres and other papermaking solids in the paper slurry. The machine side layer should be tough and durable, and provide a measure of dimensional stability to the forming fabric so as to minimize fabric stretching and narrowing, or other distortions.

The role of forming fabrics is particularly significant in relation to their specific contribution to sheet properties, in that excessive drainage will adversely affect good sheet formation. In particular, any irregularities in drainage, including those resulting from variations in the main body of the fabric or at the seaming area, will generally result in marking, i.e. visible imperfections in the appearance of the eventual finished sheet; or in inconsistencies which affect tear strength and good printing quality.

DISCUSSION OF THE PRIOR ART

In the known weave patterns for double layer forming fabrics in which the warp yarns comprise binder pairs, alternately forming part of the paper side and the machine side weaves, when one member of a pair passes from the paper side layer to the machine side layer, the second member of the pair exchanges position with the first member by passing from the machine side layer to the paper side layer, thus completing the weave pattern while binding the two layers together. Examples of such patterns are found, for example, in published US application No. 2003/0217782 of Nagura et al., and in U.S. Pat. Nos. 5,054,525 and 5,152,326 to Vohringer; 4,605,585 to Johansson; 4,501,303 to Osterberg; U.S. Pat. No. 6,223,780 to Kaldenhoff; U.S. Pat. No. 4,564,051 to Odenthal; U.S. Pat. No. 4,564,052 to Borel; U.S. Pat. No. 4,705,601 and U.S. Pat. No. 5,219,004 both to Chiu; U.S. Pat. No. 4,729,412 to Bugge; U.S. Pat. No. 4,821,780 to Krenkel et al; U.S. Pat. No. 5,454,405 to Hawes; U.S. Pat. No. 6,253,796 to Wilson et al; U.S. Pat. No. 7,048,829 to Heger et al; EP 1195462 and U.S. Pat. No. 6,896,009 both to Wilson et al. Similarly, triplet yarns can be used as binders, occupying a single combined path in the paper side surface, for example as taught in U.S. Pat. No. 6,202,705 to Johnson et al.

It is also known from Danby et al. in WO 06/034576, which is incorporated herein in its entirety, that restricting drainage through a notional centre plane in a forming fabric, i.e. a notional plane between the PS and MS layers of the fabric, and substantially parallel to the general plane of those layers, will provide improvements in sheet formation. Specifically, as noted above, straight-through drainage in areas of the fabric that are relatively open will cause sheet marking due to more rapid drainage of fluid in this area than in other locations in the fabric.

Drainage area thus provides an indication of how easily fluid will drain through the fabric, in that the smaller the drainage area, the slower the fluid drainage will occur. Fabric constructions such as those disclosed in WO 06/034576 provide a small drainage area in the centre plane of the fabric structure when compared with the drainage at the MS and PS surfaces.

In fabrics according to the present invention, as all of the warp yarns are integrated into both the PS and MS surfaces, they must also therefore all pass through the centre plane of the fabric. The warp yarn density in that plane thus reduces the drainage area and creates an improved resistance to drainage. The higher the yarn density, the greater the resistance, hence the term "Centre Plane Resistance", or CPR.

For the purposes of this discussion, the method of calculation of the drainage area (or CPR) of a fabric according to the invention is as follows, starting from the assumptions that (1) all of the warp yarns pass through the centre plane and that when they are all side by side in close packed order they would cover 100% of the centre plane, i.e. the centre plane would be 100% closed; and (2) that the pattern repeat for one warp yarn represents the whole fabric. When a warp yarn leaves the centre plane to pass from one fabric layer to the other, i.e. up to the PS, or down to the MS, it opens up the centre plane from its original 100% closed situation, by an amount equal to the yarn diameter (or equivalent dimension for non-circular yarns). When the warp stays on either the PS or MS, the unoccupied space in the centre plane also becomes part of the "open" volume and is equal to the total distance that the warp yarn is out of the centre plane, divided by the length of the pattern repeat as determined by the number of PS weft yarns.

Drainage area will be influenced by the number of weft yarns per unit length (known as "knock"), weft yarn diameter (or equivalent dimension), the length of the pattern repeat, and the number and length of warp yarn floats out of the centre plane. These factors, together with the yarn volumes displaced from the centre plane by the weave pattern, can be input into a computer algorithm to calculate the drainage areas. A more detailed discussion of drainage areas and their significance, and the outcome of these calculations, is provided in "Float Forming", a paper presented at the 92$^{nd}$ annual meeting of PAPTAC in 2006, by Roger Danby and Dr. Dale Johnson.

However, although the problems of rapid overall drainage can be addressed by restricting the overall drainage rate in the centre plane, there is a further problem in double layer fabrics resulting from inconsistencies in drainage rates across the paper side layer, which can result from the otherwise desirable characteristics of the chosen weave pattern. The particular advantages of the use of warp binder pairs have an associated disadvantage arising from the exchange points, i.e. where the two members of the pair (or three members of triplets) exchange positions between the paper side layer and the machine side layer. The weave patterns which are selected to provide an optimum support surface in the paper side, combined with an optimum wear resistance in the machine side, often result in the exchange points being located in a diagonal line in the fabric. Along such diagonal lines, there will be a line of reduced drainage, and between diagonal lines there will be a significantly more open drainage area. The consequent inconsistencies in drainage rates result in sheet marking, and this problem tends to be greater as the angle of the diagonal line to the CD increases, i.e. the closer the diagonal line comes to being parallel to the MD. Until now, it has not been feasible to alter the configuration of the exchange points and thus enhance the paper side surface and layer of the fabric, without at the same time creating an adverse effect on the available weave patterns which are able to meet the different requirements for the machine side layer and surface.

This problem is recognized by Martin et al. in U.S. Pat. No. 6,834,684, U.S. Pat. No. 6,953,065 and U.S. Pat. No. 7,048,012, which teach forming fabric constructions having dedicated PS and MS warp yarns systems each of which interweave with the paper and machine side layer weft yarns only, and which further include a system of warp yarn pairs which interweave between the PS and MS to bind the fabric layers together. Due to the differing path lengths of the warp yarns in each of these 3 yarn systems (the dedicated PS warp, the dedicated MS warp and the interweaving pairs), the fabric will require at least 3 warp beams to be woven; four may be required if the path lengths of each of the two warp pair members is different (i.e. if they are woven to differing repeat lengths). Martin et al. refer to the earlier disclosures of Osterberg in U.S. Pat. No. 4,501,303; Vohringer in U.S. Pat. No. 5,152,326 and Johansson in U.S. Pat. No. 4,605,585 indicating that a disadvantage of these prior art fabrics is the strong diagonal marks that are created either by the yarn knuckles or the drainage openings due to the alignment of the yarn crossovers. Martin et al suggest that this disadvantage can be addressed by carefully adjusting the interlacing of the warp yarns to provide differing "cell lengths", i.e. by arranging the alignment of the warp yarn crossover points such that adjacent yarns from adjacent pairs have MD "cell lengths" equal to or less than the MD "cell lengths" of non-like adjacent yarns from adjacent pairs; although the concept of "cell lengths" is not defined in any of these three patents.

The weave structure suggested by Martin et al. suffers from the disadvantage of requiring a minimum of three warp beams to manufacture. Although Martin et al. do indicate some advantageous embodiments of their invention (e.g. when the crossover repeat pattern length in the CD can be divided into the CD weave pattern repeat and the outcome is a multiple of two, and like yarns in crossovers along the same CD line extend in opposite directions, then the pattern can be woven on a loom with half the number of frames for a pattern repeat needed if the loom is threaded for a fancy draw), the fabrics suggested would be more expensive and time-consuming to produce than those of the prior art. Further, it would appear that the teachings of Martin et al. could only be implemented in a limited number of patterns, each requiring the dedicated PS and MS warp yarns; and the patents do not teach any manner in which the "differing cell lengths" could be provided in any multi-layer fabric, particularly a double layer fabric where all the warp yarns are binder yarns.

Having regard to the many known advantages of providing for all the yarns of one direction to be binder yarns, it would be desirable to provide weave patterns having this feature, and in which the problems of diagonal lines from the exchange points are substantially reduced or eliminated, while retaining the preferred weave patterns to provide the required characteristics for the machine side layer.

It has now been discovered that it is possible to distribute the drainage openings more uniformly in a forming fabric having binder warp yarns by providing a non-consecutive, or inverted, order of insertion of the members of each of the pairs of yarns according to the present invention. The features of the invention are applicable to any double layer fabric where all the warp yarns are binder pairs; but in particular, it has also been found to be possible, using the fabrics of the present invention, to retard fluid drainage in the manner as taught by Danby et al. in WO 06/034576, and thereby provide further improved formation properties. This can be done by arranging the order of the warp yarns in every yarn pair in the fabrics so that the first member of each pair of warp yarns is always adjacent to the first pair member of an adjacent pair of warp yarns, and the second member of each pair of warp yarns is always adjacent to a second pair member of an adjacent pair of warp yarns.

SUMMARY OF THE INVENTION

The present invention seeks to provide a forming fabric including at least a first set of weft yarns located and arranged in the paper side layer of the fabric, a second set of weft yarns located and arranged in the machine side layer of the fabric, and a single system of warp yarns, the yarns of which are ordered in pairs, wherein the first member of each pair of warp yarns is always adjacent to the first member of an adjacent pair of warp yarns, and the second member of each pair of warp yarns is always adjacent to a second member of an adjacent pair of warp yarns. This sequence is followed across the fabric width. Thus, as more particularly described below with reference to the drawings, in relation to any two adjacent pairs of warp yarns, the order of each yarn of one pair at each exchange point is inverted in orientation from the order of each yarn of the adjacent pair at the closest exchange point for the adjacent pair. The overall effect of this transposition of the insertion order of the warp yarn pair members is to break up the continuous diagonal lines of warp yarn exchanges having the same direction that are present in fabrics according to the prior art, by increasing the distance between successive yarn knuckles in the paper side surface, and thereby reducing any propensity for sheet marking due to obstructions in fabric drainage.

In the warp tied fabrics of the prior art, forming fabric weave designs generally required that the machine direction (MD) warp yarns be organized so that they were located in the same relative position throughout the weave, relative to the warp arrangement of the paper side layer. For example, the warp knuckles or interchanges formed by each of the warp yarns 1,2,3 . . . 8 in one repeat of the fabric weave design would occur in the following sequence: 1/2, 3/4, 5/6, 7/8, and so on, wherein the notation "1/2" means that the warp yarns are arranged in pairs, and warp 2 appears to the right of warp 1, warp 4 appears in the fabric to the right of warp 3, and so on. In these fabrics, the warp interchanges occur at a regular spacing with the second yarn of each pair appearing in the PS to the right of the first MD yarn of the "ordered" pair. This "regular" or constant arrangement of the warp yarns always places them in the same relative position within the fabric, with the disadvantages as discussed above.

In the present invention, the MD yarns are arranged such that the order of the yarns of every alternate warp yarn pair is inverted in relation to its position in the original weave pattern, as seen from the paper side surface. For example, in the weave pattern according to the prior art, as noted above, the MD yarns in each yarn pair are sequenced so that all follow or appear in the same order: left-right, left-right, or 1/2, 3/4, 5/6, and so on. In this invention, the sequence of the MD yarns of every second pair is inverted, so that they would appear in the following order in the fabric: left-right, right/left, left-right, right/left, or 1/2, 4/3, 5/6, 8/7, 1/2, etc. This creates increased randomness in the fabric which substantially reduces or eliminates the periodic internal blockages and drainage channels that occur in fabrics of the prior art. As discussed more particularly below with reference to the drawings, this inversion of the yarns of adjacent pairs results in a change in orientation of each exchange point of a yarn pair in relation to the closest exchange point of each adjacent yarn pair.

An important advantageous effect of the inversion is the increased spacing between adjacent knuckles, which further contributes to an improved uniformity of the paper sheet.

In a first broad embodiment, the invention therefore seeks to provide a double layer forming fabric for a papermaking machine woven to an overall repeating weave pattern and comprising a paper side layer and a machine side layer, wherein the fabric has (i) at least one set of paper side layer weft yarns;

(ii) at least one set of machine side layer weft yarns; and (iii) a set of warp yarns comprising only pairs of binder warp yarns interwoven with the sets of weft yarns, each pair comprising a first and second member, wherein (a) in the paper side surface, each pair of binder warp yarns occupies a single combined path comprising at least a first and second segment, wherein the first and second members of the pair exchange positions at an exchange point between each successive segment and are laterally displaced in relation to each other at and between each exchange point; and (b) for each successive pair, an order of insertion of the first and second members in relation to each other into the overall repeating weave pattern is inverted in relation to an order of insertion of the first and second members of an immediately preceding pair, such that in the woven fabric for each exchange point, (i) each first member is adjacent to a first member of a first adjacent pair at the closest exchange point for the first adjacent pair, and (ii) each second member is adjacent to a second member of a second adjacent pair at the closest exchange point for the second adjacent pair.

In a second broad embodiment, the invention seeks to provide a double layer forming fabric as described above, wherein for each pair of binder warp yarns, (i) in the first segment of the single combined path, the first member of the pair interweaves with selected paper side layer yarns, and the second member of the pair interlaces with at least one machine side layer yarn at an interlacing location;

ii) in the second segment of the single combined path, the second member of the pair interweaves with selected paper side layer yarns, and the first member of the pair interlaces with at least one machine side layer yarn; and (iii) for each member, between each exchange point and an immediately subsequent interlacing location, and between each interlacing location and an immediately subsequent exchange point, the member floats between the paper side layer yarns and the machine side layer yarns under at least four paper side layer yarns.

Preferably, the fabric further comprises a centre plane within the fabric, defined as a notional plane substantially parallel to and located between the paper side layer and the machine side layer, which has a centre plane drainage area which is between 8% and 20%.

Preferably also the binder warp yarns occupy at least 80% of the centre plane in each repeat of the overall repeating weave pattern.

Preferably in the fabrics of the invention the paper side layer is woven to a pattern selected from a plain weave, a 3-shed twill, a 3-shed satin, a 4-shed twill, a 4-shed broken twill and a 4-shed satin.

Preferably, the machine side layer is woven to a pattern selected from any of a twill, broken twill, satin or an N×2N or N×3N pattern where N is the number of warp yarns in the pattern repeat and 2N and 3N are respectively the number of weft yarns, and N is at least 3. Thus, suitable machine side weave patterns for use in the fabrics of this invention can be those woven according to 4, 5, 6, 8, 10 and 12-shed patterns, but the invention is not so restricted.

Preferably, the overall repeating weave pattern requires between 12 and 48 sheds in the loom; more preferably between 12 and 36 sheds in the loom, and most preferably either 16 or 24 sheds in the loom.

Preferably, the fabric is woven using a single warp beam loom, or alternatively a double warp beam loom.

Preferably, each exchange point is separated from the closest exchange point for each adjacent yarn pair by between 0 and 8 paper side layer weft yarns, most preferably by 0, 2 or 4 paper side layer weft yarns.

Preferably, the warp yarns are constructed of a high modulus polymer material; more preferably, the high modulus polymer material is selected from polyethylene terephthalate (PET), polyethylene naphthalate (PEN) and a para-aramid synthetic fiber.

Preferably, the paper side layer weft yarns are constructed of a material selected from PET and polyamides.

Preferably, the machine side layer weft yarns are constructed of a material selected from PET, polybutylene terephthalate (PBT), polyamide, and a blend of PET and polyurethane.

Preferably, the yarns of each set have a cross-sectional configuration selected from substantially circular, ovate, ellipsoid, trapezoidal, rectangular, and square.

BRIEF DESCRIPTION OF THE FIGURES

The invention will now be described in relation to the drawings, in which.

DETAILED DESCRIPTION OF THE FIGURES

Figure 1:
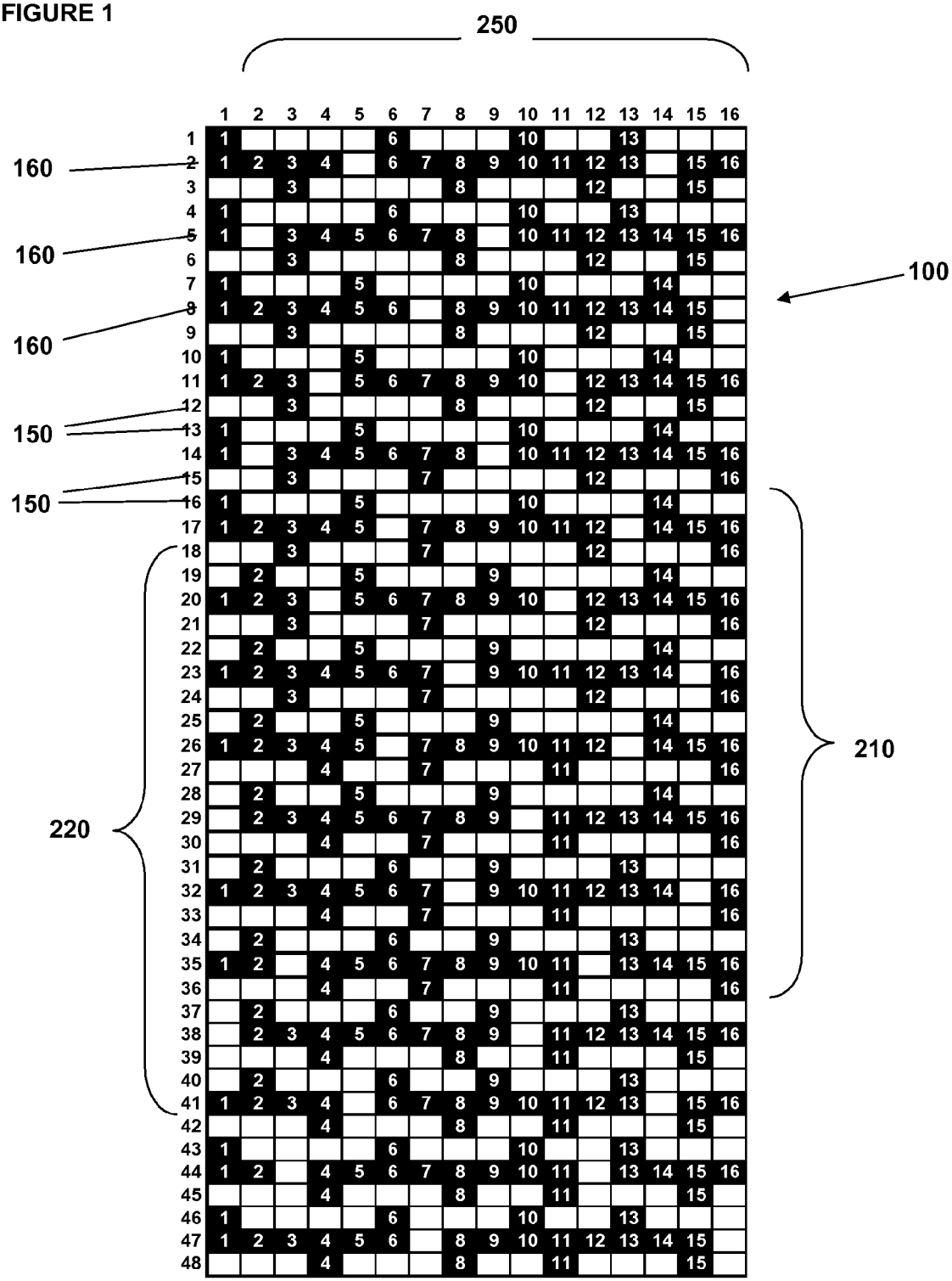
FIG. 1 is a weave diagram of a fabric according to the prior art.

FIG. 1 is a weave diagram of a 16-shed double layer fabric 100 according to the prior art, in which the warp yarns 250 are shown across the top of the diagram, in this case as individual warp yarns 1 to 16. These warp yarns are woven in pairs (shown as adjacent yarns 1/2, 3/4, 5/6 . . . ) and the paper side layer weft yarns 150 and the machine side layer weft yarns 160 are identified down the left side of the diagram as individual yarns 1 to 48, in which every third yarn (2, 5, 8, 11 . . . ) is a machine side layer weft yarn 160.

It can be seen that in this weave pattern, the pairs of warp yarns 250 each form a single combined path in the paper side layer, and every warp yarn 250 is a binder yarn, i.e. it serves to bind the paper side layer and the machine side layer together, and there are no warp yarns dedicated solely to either layer. In this combined path, each member of each pair of warp yarns 250 follows a path having a first and second segment, 210 and 220, separated by exchange points 230 (discussed further below in relation to FIG. 7), at which the first and second members of the pair exchange positions, from the paper side layer to the machine side layer and vice versa. In the first segment 210 (shown in FIG. 1 for warp yarn 16, between paper side layer weft yarns 15 and 36), the warp yarn 250 interweaves with a series of paper side layer weft yarns 150 to form a plain weave in the paper side surface, and after exchanging positions with the other warp yarn 250 of the pair passes between the two layers of weft yarns 150, 160, and interlaces with selected machine side layer weft yarns 160 to form the desired weave pattern in the machine side surface. A typical second segment 220 is shown in FIG. 1 for warp yarn 1, between paper side layer weft yarns 18 and 42.

Figure 2:
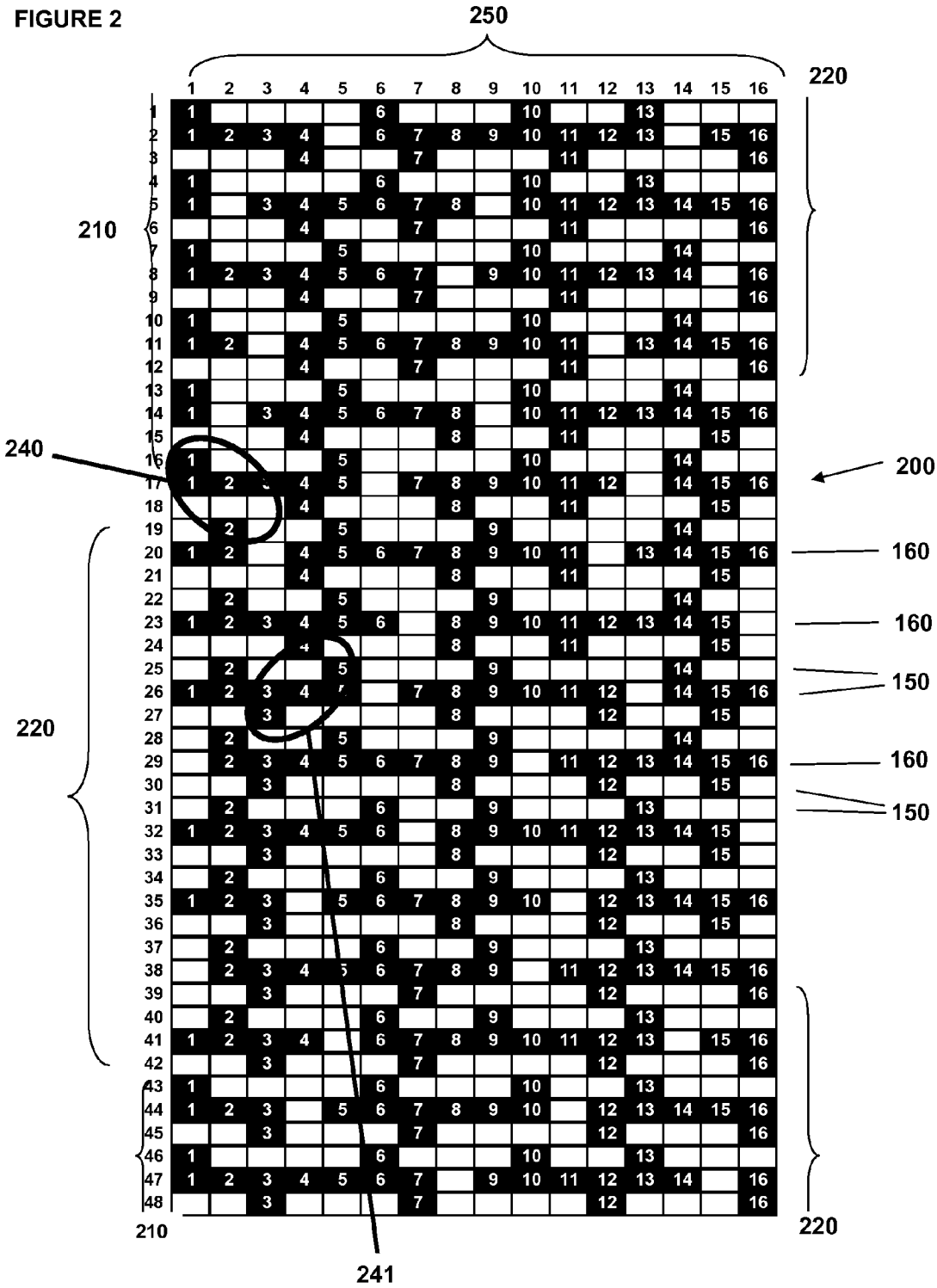
FIG. 2 is a weave diagram of a fabric according to the invention, woven according to a 16-shed pattern.

Referring now to FIG. 2, which is a weave diagram of a double layer fabric 200 of the invention, woven according to a 16-shed pattern, warp yarns 250 are shown across the top of the diagram as individual warp yarns 1 to 16. These warp yarns 250, as in FIG. 1, are woven in pairs (shown as adjacent yarns 1/2, 3/4, 5/6 . . . ) and the paper side layer weft yarns 150 and the machine side layer weft yarns 160 are identified down the left side of the diagram as individual yarns 1 to 48, in which every third yarn (2, 5, 8, 11 . . . ) is a machine side layer weft yarn 160.

It can be seen that in this weave pattern, as in FIG. 1, the pairs of warp yarns 250 each form a single combined path in the paper side layer, and every warp yarn 250 is a binder yarn, i.e. it serves to bind the paper side layer and the machine side layer together, and there are no warp yarns dedicated solely to either layer. Similarly, in this combined path, each member of each pair of warp yarns 250 follows a path having a first and second segment, 210 and 220, separated by exchange points 240, 241 (discussed further below in relation to FIGS. 8 and 9), at which the first and second members of the pair exchange positions, from the paper side layer to the machine side layer and vice versa. In the first segment 210, the warp yarn 250 interweaves with a series of paper side layer weft yarns 150 to form a plain weave in the paper side surface, and after exchanging positions with the other warp yarn 250 of the pair passes between the two layers of weft yarns 150, 160, and interlaces with selected machine side layer weft yarns 160 to form the desired weave pattern in the machine side surface. A typical first segment 210 is shown in FIG. 2 in relation to warp yarn 1, commencing at paper side layer weft yarn 43, and continuing to paper side layer weft yarn 16 in the next repeat. A typical second segment 220 is shown in FIG. 2 in relation to warp yarn 2, between paper side layer weft yarns 18 and 42.

In contrast with the weave pattern of FIG. 1, in the weave pattern of FIG. 2, it can be seen that for alternate pairs of warp yarns 250, the order of insertion of the pair members into the weave has been inverted. Thus, considering warp yarns 3 and 4, in FIG. 2 warp yarn 3 follows the path which warp yarn 4 follows in FIG. 1; and warp yarn 4 in FIG. 2 follows the path which warp yarn 3 follows in FIG. 1. For the preceding pair and the next pair, comprising warp yarns 1 and 2, and 5 and 6, each yarn follows the same path as followed by the respective one of warp yarns 1 and 2, 5 and 6 in FIG. 1. For the following pair, comprising warp yarns 7 and 8, warp yarn 7 in FIG. 2 follows the path which warp yarn 8 follows in FIG. 1, and warp yarn 8 in FIG. 2 follows the path which warp yarn 7 follows in FIG. 1.

The result of this inversion of the order of insertion of members of alternate pairs of the warp yarns 250 is a significant change in location and orientation of the exchange points 240, 241, as discussed further below in relation to FIG. 5 in comparison with FIG. 3; and in relation to FIGS. 8 and 9 in comparison with FIG. 7, and in relation to FIG. 12 in comparison with FIG. 11.

In this pattern, each warp yarn 250, after leaving the paper side layer 110, remains between the paper side layer 110 and the machine side layer 130, in a notional centre plane between the layers, having an internal float under at least four paper side layer weft yarns 150, before interlacing with a machine side layer weft yarn 160; and thereafter has a second internal float under at least four paper side layer weft yarns 150 before passing back up into the paper side layer 110 at the next exchange point 240 or 241.

Figure 3:
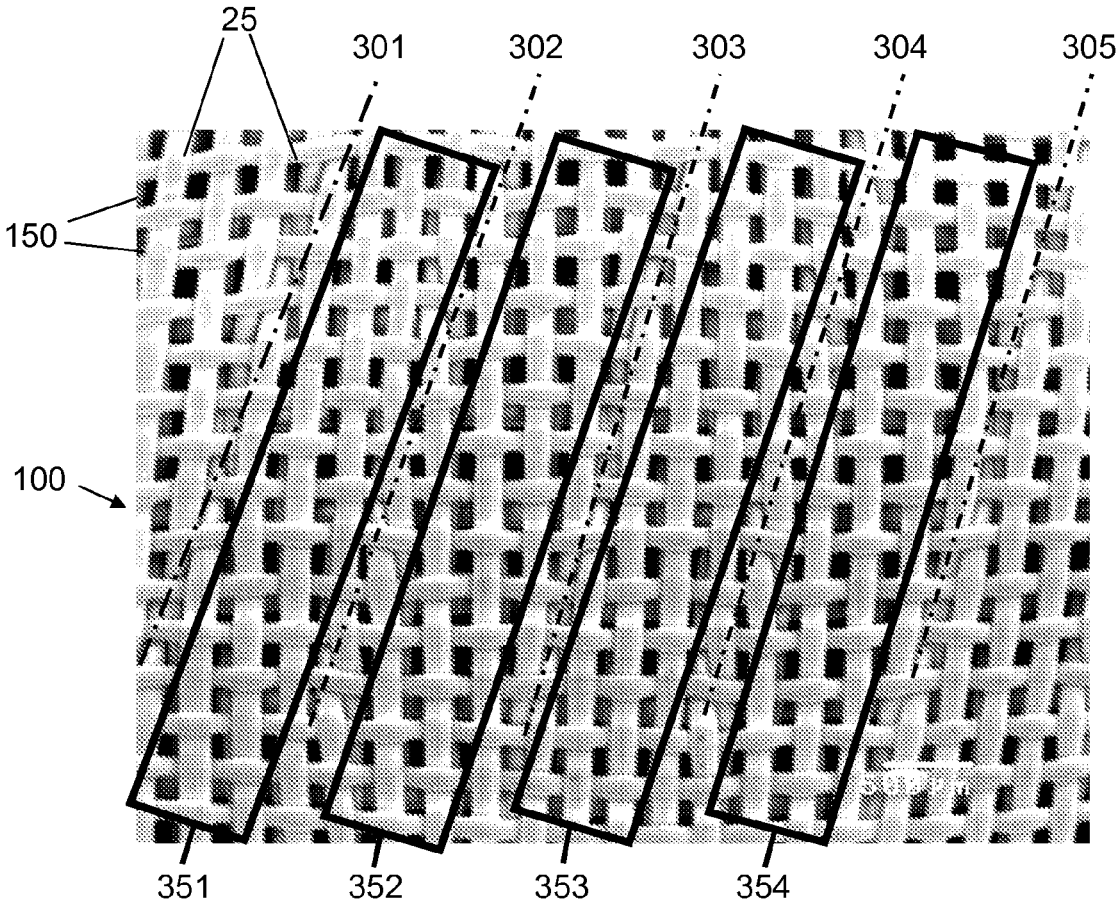
FIG. 3 is a scanning electron micrograph (SEM) of a fabric according to the prior art, showing areas of drainage non-uniformity.

Referring now to FIG. 3, which is a scanning electron micrograph (SEM) of the prior art fabric 100 woven according to the pattern shown in FIG. 1, it can be clearly seen that the exchange points 230 (not individually identified in this figure, but shown in FIG. 7) of the warp yarns 250 collectively form diagonal lines 301 to 305 in the paper side surface 120 of the fabric 100. This confluence of exchange points creates openings 351 to 354 through the fabric, and the diagonal lines 301 to 305 serve to block or restrict fluid flow through the fabric, causing it to divert to the more open areas 351 to 354 where it can more readily pass through the fabric. This creates an uneven drainage pattern which is evidenced in the hand sheet sample shown in FIG. 4, and causes cloudy formation.

Figure 4:
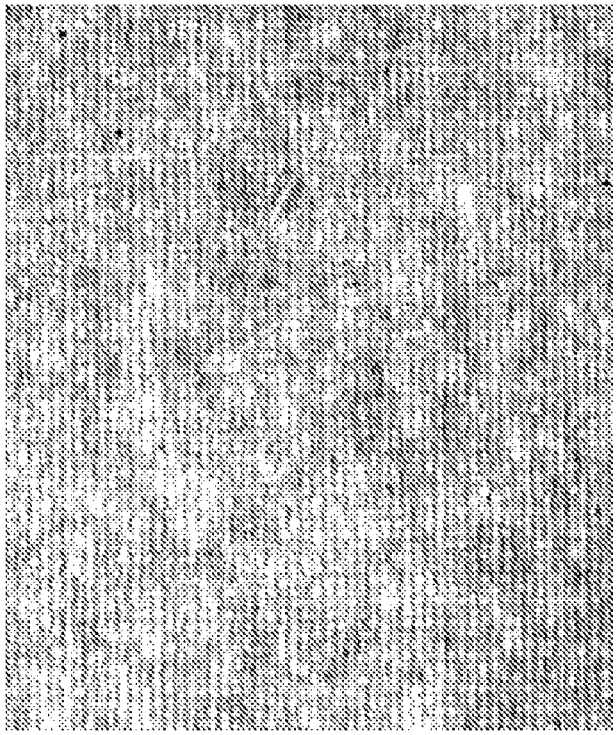
FIG. 4 is a photograph of a paper sheet formed on a fabric according to the prior art.

FIG. 4 is a photograph taken using transmitted light (through the sheet from below) of a hand sheet 400 (a sheet of paper formed by hand in a sheet former, used to predict fabric performance) formed on the prior art fabric shown in FIG. 3. It can be seen that, although the formation characteristics of the hand sheet are likely adequate for many applications, improved printability for example could be obtained if the wire mark could be eliminated or at least reduced.

Figure 5:
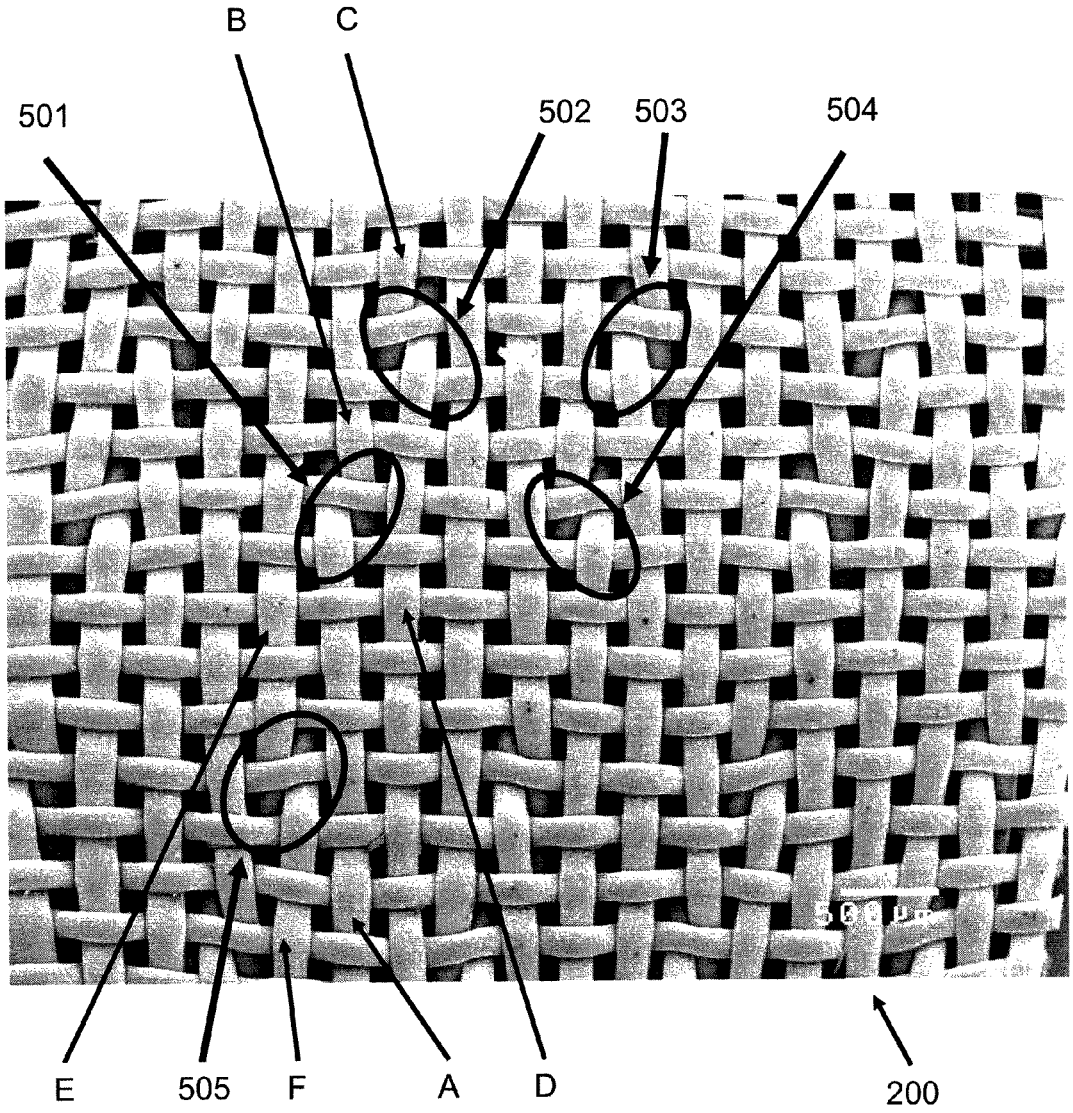
FIG. 5 is an SEM of the paper side surface of a fabric according to a first embodiment of the invention.

FIG. 5 is an SEM of a fabric 200 woven according to the teachings of the present invention. In the discussion of the features shown in this figure, the paths of the warp yarns are described commencing at the top of the figure, so that the use of the terms "up" and "down" in relation to the passing of those yarns into and out of the paper side layer should be understood in the context of the yarn paths as seen in the direction from the top to the bottom of the figure.

Unlike the fabric 100 shown in FIGS. 1 and 3, the fabric shown in FIG. 5 has been woven so that like pair members of each pair of warp yarns are adjacent to one another. For example, at the exchange point 241 identified as 501, warp yarn B exchanges with warp yarn A, so that warp yarn B passes down into the fabric from the paper side layer and warp yarn A passes up into the paper side layer. If warp yarn A is the first member of the A/B pair, then adjacent warp yarn F is the first member of the closest adjacent pair E/F, although it is inserted into the weave after (to the right of) warp yarn E; similarly, as warp yarn B will be the second member of the A/B pair, then adjacent warp yarn C is the second member of the closest adjacent pair C/D, although it is inserted into the weave before (to the left of) warp yarn D. Thus, for any two adjacent warp yarn pairs, at each exchange point for the first pair, the order of insertion of the individual members of that pair is inverted in relation to the order of insertion of the members of the second pair, when considered in relation to the closest exchange point for the second pair, where the term "closest" is used in the sense of there being the least number of weft yarns between the two exchange points under consideration.

As can be clearly seen from FIG. 5, the effect of this alternating inversion of the order of insertion into the weave is that for this fabric 200, unlike the prior art fabric 100, there is no diagonal line of exchange points 230 having the same orientation, but instead the exchange points 240, 241 (as identified in FIG. 2) have alternating opposing orientations, as indicated at 501 to 505. Due to the inventive arrangement of the warp yarns, the exchange points are arranged across the CD (horizontally in the Figure), do not form diagonal lines, and are thus much less apparent. Therefore, any adverse effects on drainage consistency and paper sheet quality are minimized.

Figure 6:
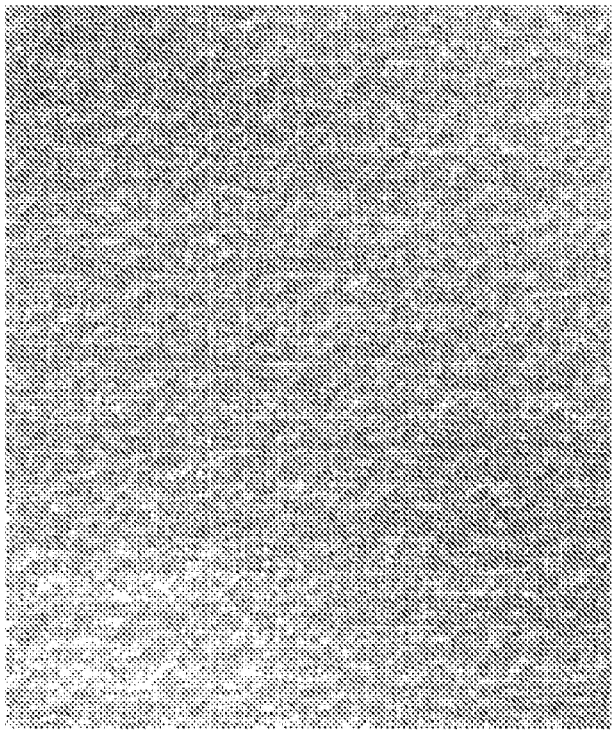
PRIOR ART FIGURE 6
FIG. 6 is a photograph of a paper sheet made on a fabric according to the invention.

FIG. 6 is a photograph similar to that shown in FIG. 4 taken using transmitted light of a hand sheet 600 formed on the fabric 200 shown in FIG. 5. The sheet exhibits much less "wire mark" than the sheet 400 formed on the prior art fabric 100 and would be expected to have improved quality for printability and similar applications where surface uniformity is important.

Figure 7:
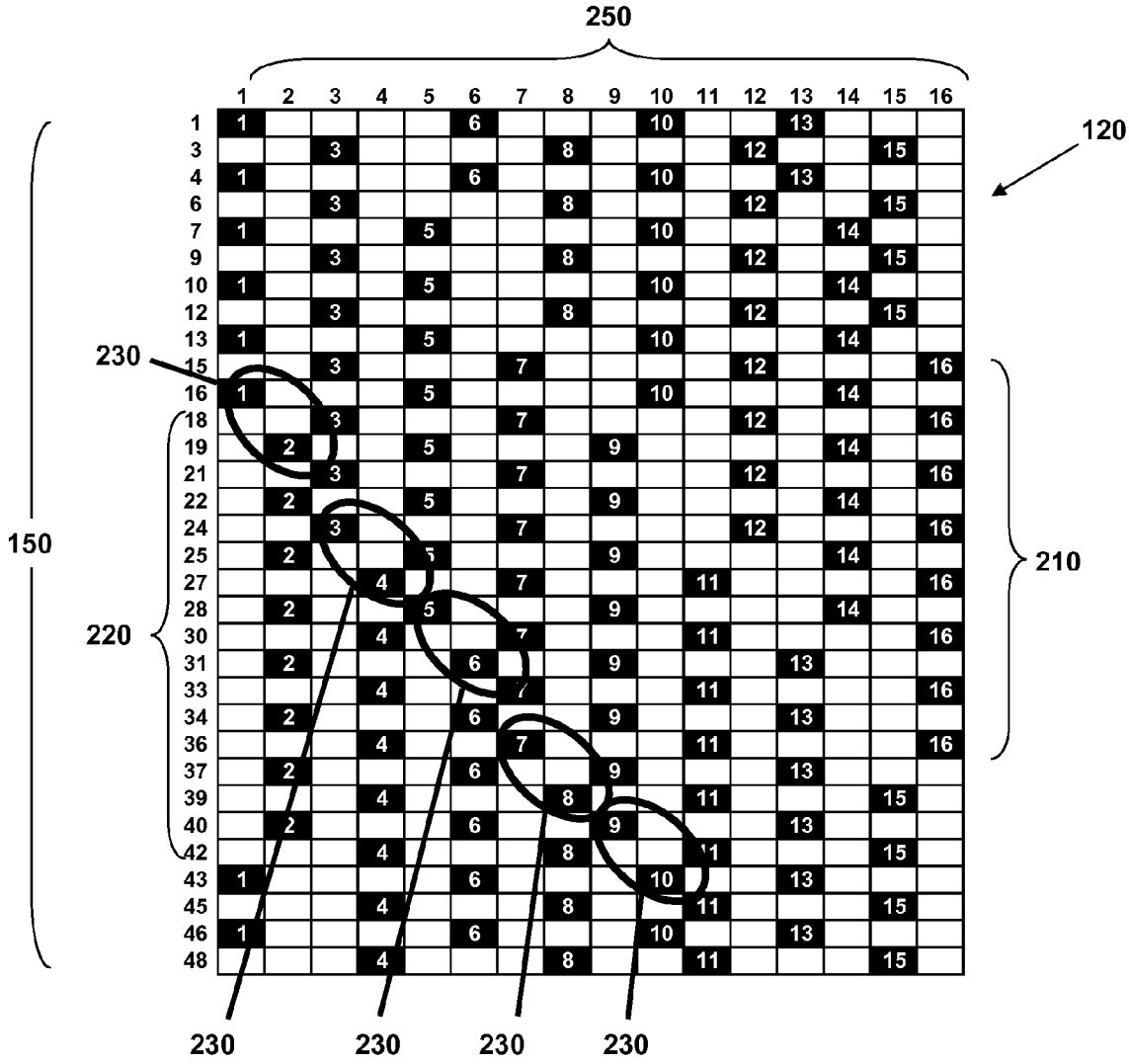
FIG. 7 is a weave diagram showing the paper side surface of a prior art warp tied forming fabric.

FIG. 7 is a weave diagram showing the paper side surface 120 of the prior art fabric 100, corresponding to the complete weave diagram of FIG. 1, i.e. it shows the warp yarns 250 and the PS weft yarns 150 as shown in FIG. 1, but the machine side weft yarns 160 are excluded. The black squares represent knuckles on the paper side surface 120 of the fabric. It can be seen that warp yarns 1 and 2 exchange positions between wefts 16 and 19 and between wefts 40 and 43; warp yarns 3 and 4 exchange positions between wefts 24 and 27; warp yarns 5 and 6 exchange positions between wefts 4 and 7 and between wefts 28 and 31; warp yarns 7 and 8 exchange positions between wefts 12 and 15 and between wefts 36 and 39; and warp yarns 9 and 10 exchange positions between wefts 16 and 19 and between wefts 40 and 43. It can be seen that these exchange points 230 are regularly arranged and form diagonals from the upper left to the lower right of the pattern, for example the series of exchange points 230 identified by ellipses on the figure, each such diagonal line corresponding to the lines 301, 302, 303, 304 and 305 shown in FIG. 3.

Figure 8:
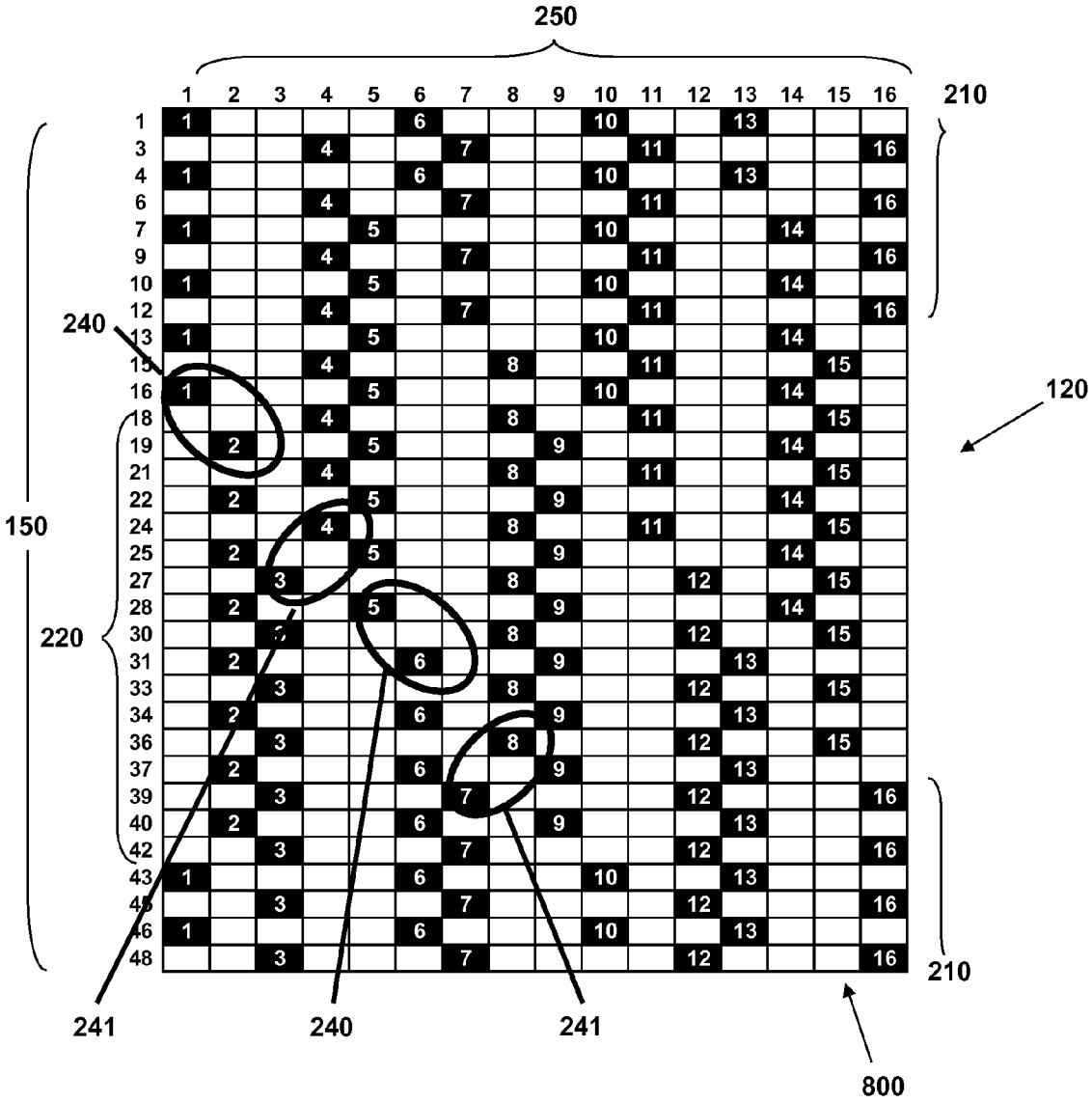
FIG. 8 is a weave diagram of the paper side surface of the fabric of FIG. 2 showing the orientation of exchange points.

FIG. 8 is a weave diagram showing the paper side surface 120 of a fabric 800 woven according to the teachings of the present invention, showing the warp yarns 250 and the paper side layer weft yarns 150, but with the machine side weft yarns 160 excluded. It can be seen that the exchange points 240, 241 on adjacent warp yarn pairs 250, for example between warp yarns 1 and 2 between weft yarns 16 and 19, and between warp yarns 3 and 4 between weft yarns 24 and 27, are not oriented in the same direction, and the various exchange points 240, 241 in the pattern do not form diagonal lines of identically oriented points having restricted drainage.

Figure 9:
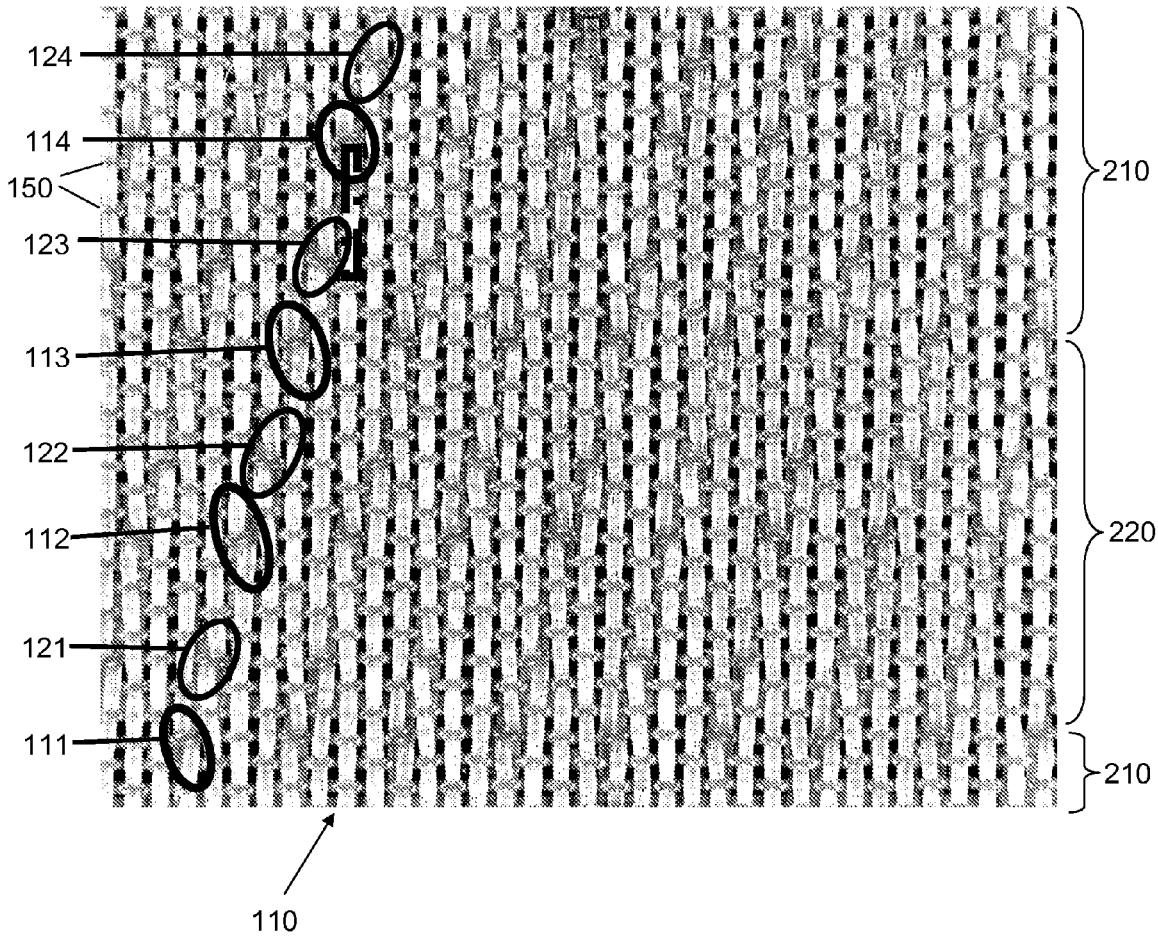
FIG. 9 is a photograph of the paper side surface of a fabric woven in accordance with the weave diagram of FIG. 2.

FIG. 9 is a photograph of the paper side surface 120 of the paper side layer 110 of a fabric woven in accordance with the weave diagram of FIG. 2, with various exchange points 240, 241 identified as ellipses. In the discussion of the features shown in this figure, the terms "up" and "down" are used in the same manner as in relation to FIG. 5, i.e. the passing of the warp yarns into and out of the paper side layer should be understood in the context of the yarn paths as seen in the direction from the top to the bottom of the figure.

In FIG. 9, those ellipses which correspond in orientation with exchange point 240 in FIG. 2 are identified as ellipses 111 to 114, and it can be seen that each of ellipses 111 to 114 shows an exchange wherein the first (left) warp yarn 250 of a pair passes down from the paper side layer 110, and the second (right) yarn of that pair passes up into the paper side layer 110. Similarly, each of ellipses 121 to 124, corresponding in orientation to exchange point 241 in FIG. 2, shows an exchange wherein the left warp yarn 250 of a pair passes up into the paper side layer 110, and the right yarn of that pair passes down from the paper side layer 110. It can further be seen that the orientation of these exchange points 240, 241 (i.e. the ellipses as marked on the photograph) alternates when viewed moving from the lower edge towards the upper edge of the photograph; and it is clear from inspection of the complete photograph that there are no aligned groups of exchange points 230 forming any diagonal lines of restricted drainage.

Figure 10:
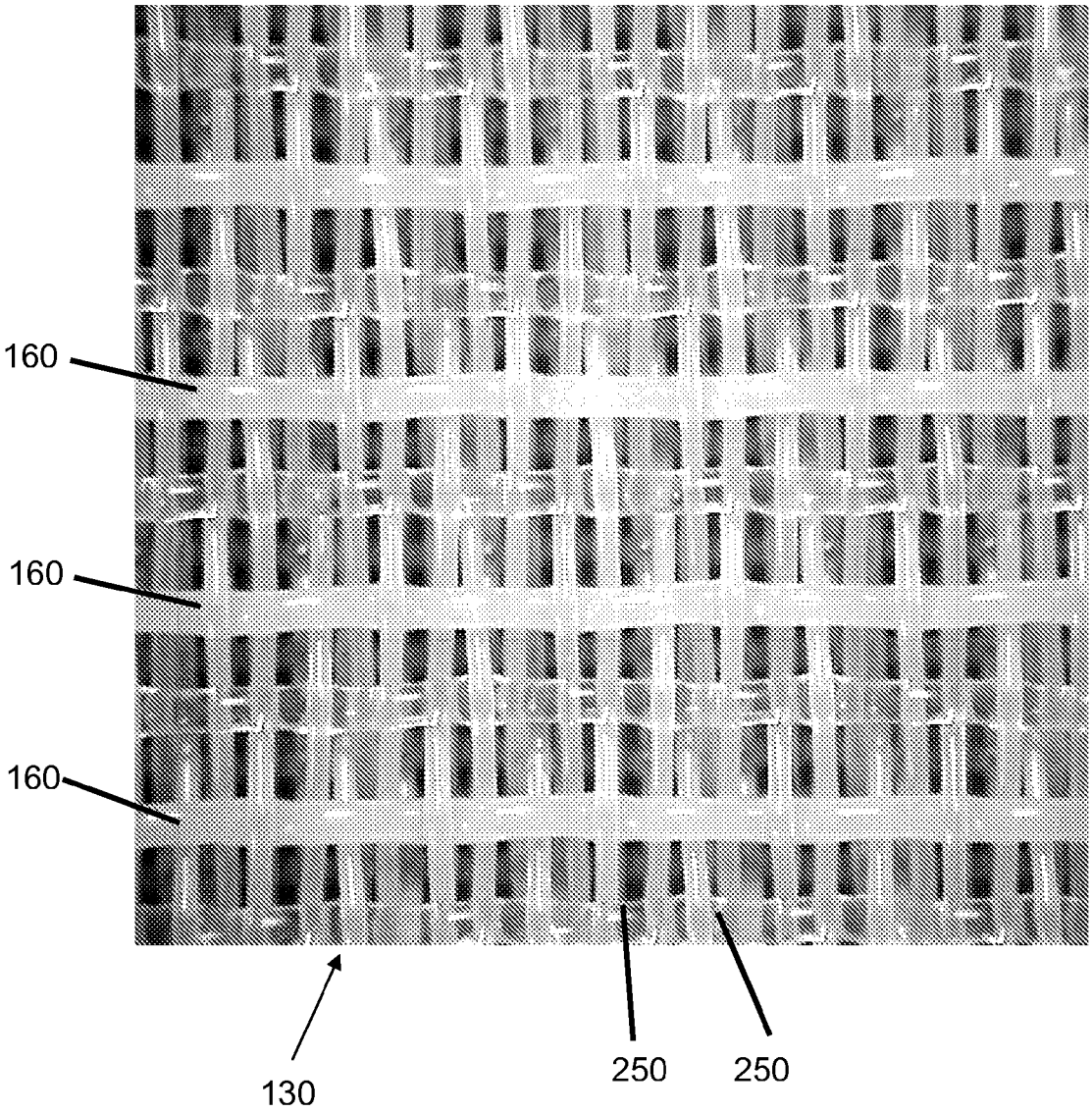
FIG. 10 is a photograph of the machine side surface of the fabric of FIG. 2.

FIG. 10 is a photograph of the machine side surface 130 of the fabric of FIG. 9, showing the interlacing of warp yarns 250 with the machine side weft yarns 160. It can be seen that the inversion of the order of insertion of members of the pairs of warp yarns 250 does not affect the ability to provide a weave pattern in the machine side layer having the desired characteristics for the intended end use of the fabric.

Figure 11:
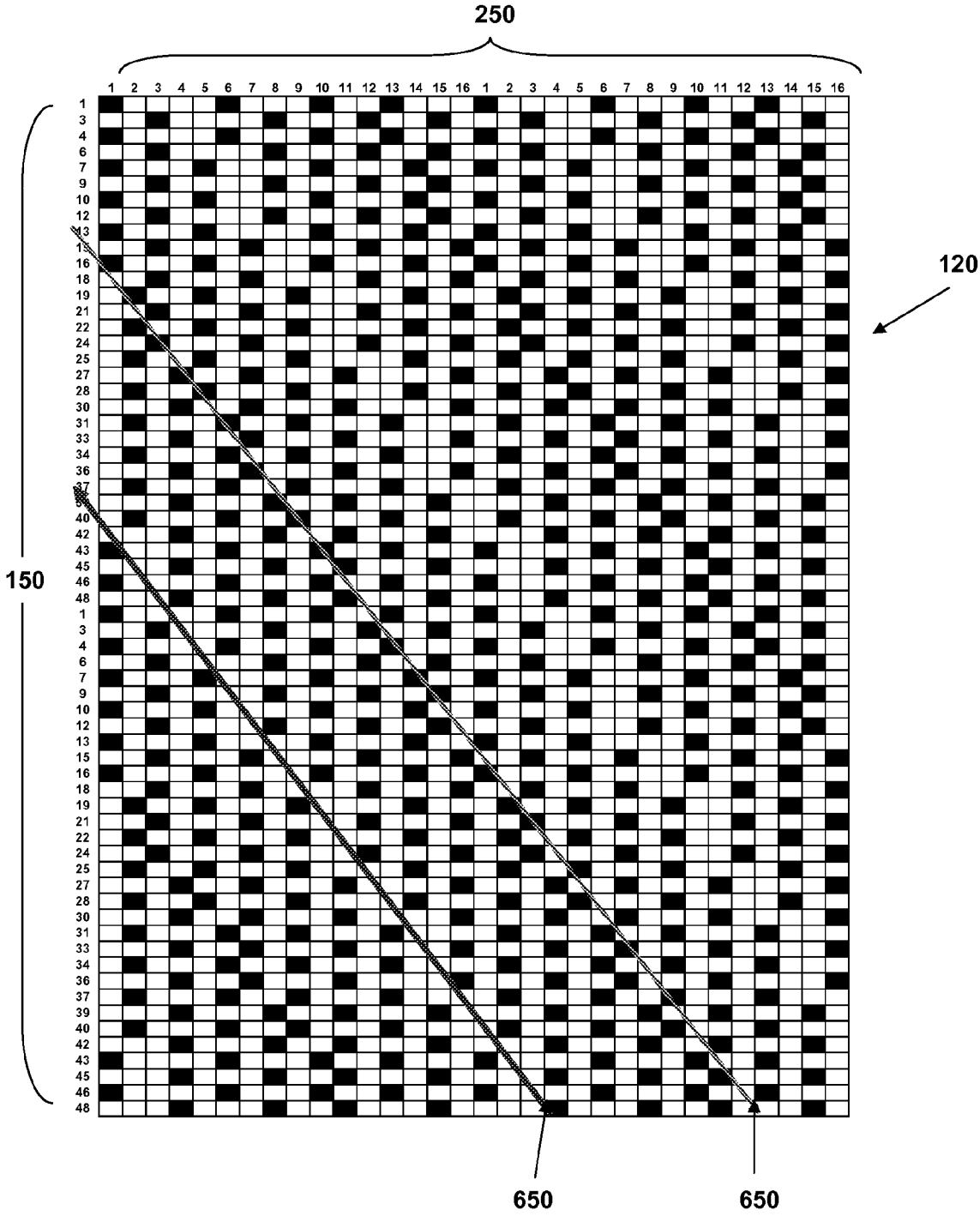
FIG. 11 is a weave diagram of the paper side surface of the prior art fabric of FIG. 1 showing two repeats in each of the machine direction and cross-machine direction.

FIG. 11 is a weave diagram of the paper side surface 120 of the prior art fabric 100 of FIG. 1 showing two repeats in each of the machine direction and cross-machine direction, in which the diagonal lines, two of which are identified by lines 650, indicative of undesirable restricted drainage can be clearly seen.

Figure 12:
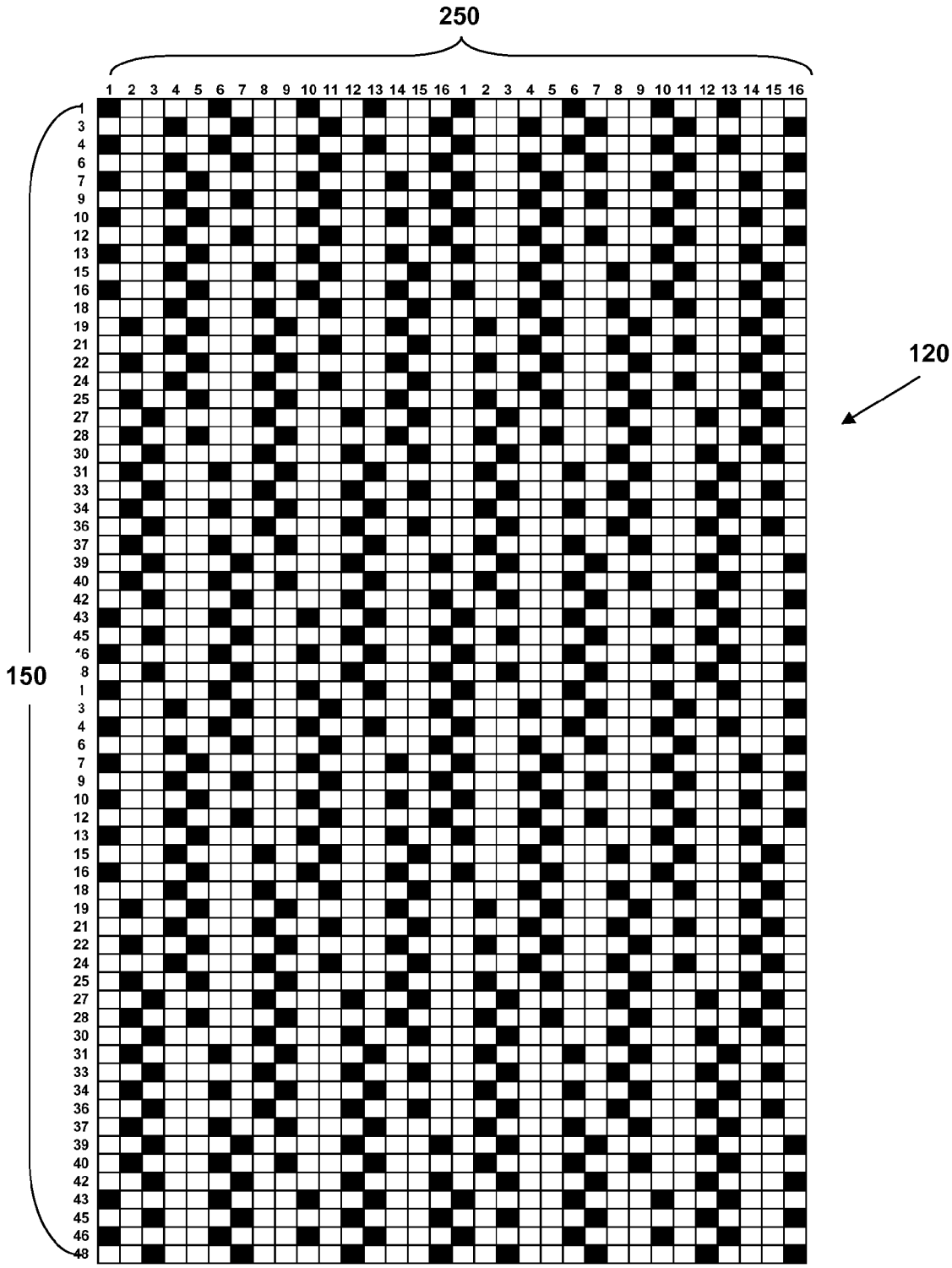
FIG. 12 is a weave diagram of the paper side surface of the fabric of FIG. 2 showing two repeats in each of the machine direction and cross-machine direction.

In contrast, referring to FIG. 12, which is a weave diagram of the paper side surface 120 of the fabric 200 of FIG. 2 showing two repeats in each of the machine direction and cross-machine direction, there are no diagonal lines created by successive exchange points 230.

Figure 13:
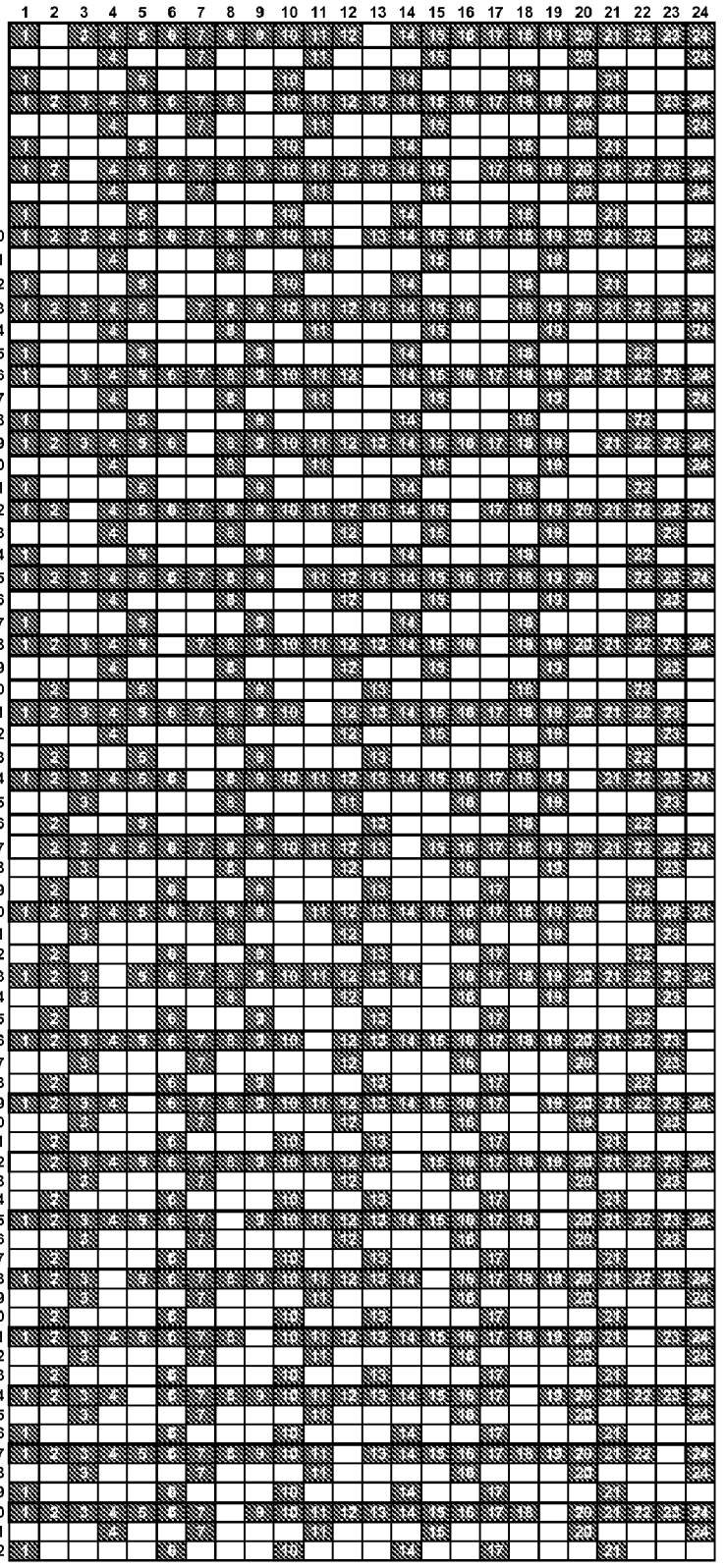
FIG. 13 is a weave diagram of a warp tied fabric according to the invention, woven according to a 24-shed pattern.
Figure 14:
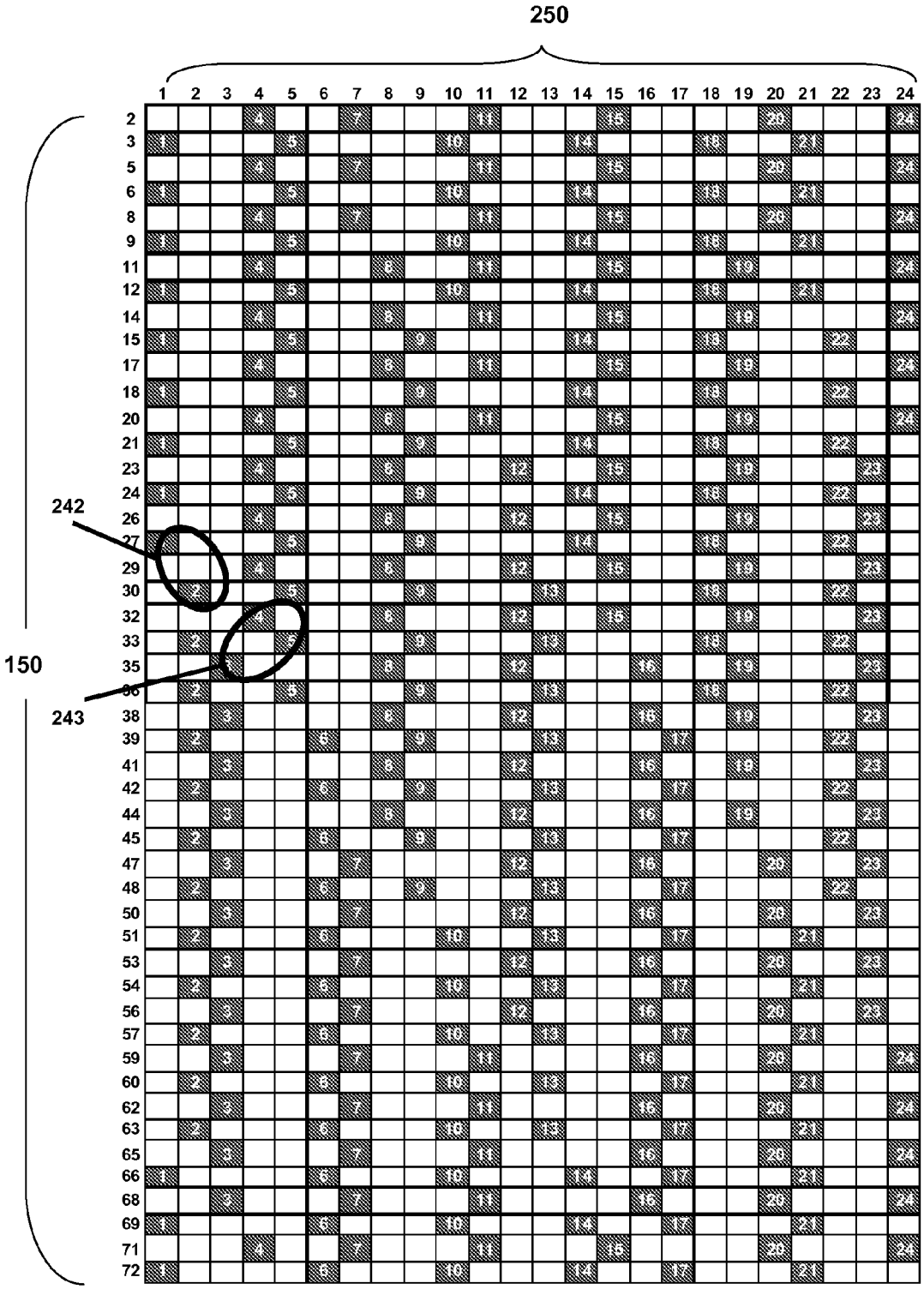
FIG. 14 is a weave diagram of the paper side surface of the fabric of FIG. 13.

Referring now to FIGS. 13 and 14, FIG. 13 is a weave diagram of a further embodiment of the invention, showing a fabric woven in a 24-shed pattern. In the diagram, warp yarns 250 are shown across the top of the diagram as individual warp yarns 1 to 24. These warp yarns 250 are woven in pairs (shown as adjacent yarns 1/2, 3/4, 5/6 . . . ), and the paper side layer weft yarns 150 and the machine side layer weft yarns 160 are identified down the left side of the diagram as individual yarns 1 to 72, in which every third yarn (1, 4, 7, 10, . . . ) is a machine side layer weft yarn 160.

FIG. 14 shows the paper side surface 120 of the fabric of FIG. 13, i.e. the machine side wefts 1, 4, 7, 10 . . . have been omitted. It can be seen from FIG. 14 that the order of insertion of the individual members of each warp yarn pair is inverted in relation to that of the adjacent warp yarn pairs at the closest adjacent exchange points, such that each exchange point has an opposing orientation to the closest exchange point for each adjacent warp yarn pair. Two typical closest exchange points are identified by ellipses 242, 243 in the figure, showing their opposing orientation.

As noted above, the invention can be applied to any double layer fabric where all the warp yarns are binder pairs, where other features of the weave pattern can be selected according to the intended end use of the fabric. The features of the invention are particularly applicable to fabrics in which fluid drainage is retarded within the centre plane of the fabric in the manner as taught by Danby et al. in WO 06/034576.

Preferably, the fabrics of the invention are constructed using a high modulus polymer material for the warp yarns. Most preferably they are comprised of either polyethylene terephthalate (PET) or polyethylene naphthalate (PEN); but other high modulus materials such as Kevlar® (registered trademark of E. I. du Pont de Nemours and Company of Wilmington, Del.) which is a para-aramid synthetic fiber, related to other aramids such as Nomex® and Technora®, may also be suitable.

The paper side layer weft yarns are preferably formed of either PET or polyamides, whilst the machine side layer weft yarns are preferably comprised of PET, polybutylene terephthalate (PBT), polyamide, or a blend of PET and polyurethane as described in U.S. Pat. No. 5,502,120.

Mixtures of yarns comprised of these polymers may also be used in either, or both, the warp or weft directions, selection of which will be dependent on the intended end use application and environment of the fabric.

Further, while the fabrics of the present invention have been described as woven using generally round polymeric monofilaments, those skilled in the art will recognize that it would be possible to use polymeric monofilaments having other cross-section shapes, such as ovate, ellipsoid, trapezoidal, rectangular, square, etc. For example, in the manufacture of certain cellulosic products, it may be advantageous for various reasons to use in the warp direction yarns having a generally round, flat or ellipsoidal cross-sectional shape, whilst in the weft direction, round, flat, ovate or trapezoidal cross-sectional yarn shapes may prove to be advantageous. Selection of an appropriate yarn cross-sectional shape for use as either the warp or weft in the fabrics of this invention will be dictated by the intended end use application and environment of the fabric and would be within the scope of the present invention.

I claim:

1. A double layer forming fabric for a papermaking machine woven to an overall repeating weave pattern and comprising a paper side layer and a machine side layer, wherein the fabric has (i) at least one set of paper side layer weft yarns;

(ii) at least one set of machine side layer weft yarns; and (iii) a set of warp yarns comprising only pairs of binder warp yarns interwoven with the sets of weft yarns, each pair comprising a first and second member, wherein (a) in the paper side surface, each pair of binder warp yarns occupies a single combined path comprising at least a first and second segment, wherein the first and second members of the pair exchange positions at an exchange point between each successive segment and are laterally displaced in relation to each other at and between each exchange point; and (b) for each successive pair, an order of insertion of the first and second members in relation to each other into the overall repeating weave pattern is inverted in relation to an order of insertion of the first and second members of an immediately preceding pair, such that in the woven fabric for each exchange point, (i) each first member is adjacent to a first member of a first adjacent pair at the closest exchange point for the first adjacent pair, and (ii) each second member is adjacent to a second member of a second adjacent pair at the closest exchange point for the second adjacent pair.

2. A double layer forming fabric according to claim 1, wherein for each pair of binder warp yarns, (i) in the first segment of the single combined path, the first member of the pair interweaves with selected paper side layer yarns, and the second member of the pair interlaces with at least one machine side layer yarn at an interlacing location;

(ii) in the second segment of the single combined path, the second member of the pair interweaves with selected paper side layer yarns, and the first member of the pair interlaces with at least one machine side layer yarn; and (iii) for each member, between each exchange point and an immediately subsequent interlacing location, and between each interlacing location and an immediately subsequent exchange point, the member floats between the paper side layer yarns and the machine side layer yarns under at least four paper side layer yarns.

3. A double layer forming fabric according to claim 1, further comprising a centre plane within the fabric, defined as a notional plane substantially parallel to and located between the paper side layer and the machine side layer, and having a centre plane drainage area which is between 8% and 20%.

4. A double layer forming fabric according to claim 3, wherein the binder warp yarns occupy at least 80% of the centre plane in each repeat of the overall repeating weave pattern.

5. A double layer forming fabric according to claim 2, further comprising a centre plane within the fabric, defined as a notional plane substantially parallel to and located between the paper side layer and the machine side layer, and having a centre plane drainage area which is between 8% and 20%.

6. A double layer forming fabric according to claim 5, wherein the binder warp yarns occupy at least 80% of the centre plane in each repeat of the overall repeating weave pattern.

7. A double layer forming fabric according to claim 1, wherein the paper side layer is woven to a pattern selected from a plain weave, a 3-shed twill, a 3-shed satin, a 4-shed twill, a 4-shed broken twill and a 4-shed satin.

8. A double layer fabric according to claim 1, wherein the machine side layer is woven to a pattern selected from a twill, broken twill, satin and an N×2N or N×3N pattern where N is the number of warp yarns in the pattern repeat and 2N and 3N are respectively the number of weft yarns, and N is at least 3.

9. A double layer fabric according to claim 1, wherein the overall repeating weave pattern requires between 12 and 48 sheds in the loom.

10. A double layer fabric according to claim 9, wherein the overall repeating weave pattern requires between 12 and 36 sheds in the loom.

11. A double layer fabric according to claim 10, wherein the overall repeating weave pattern requires 16 sheds in the loom.

12. A double layer fabric according to claim 10, wherein the overall repeating weave pattern requires between 24 sheds in the loom.

13. A double layer fabric according to claim 1, wherein the fabric is woven using a single warp beam loom.

14. A double layer fabric according to claim 1, wherein the fabric is woven using a double warp beam loom.

15. A double layer fabric according to claim 1, wherein each exchange point is separated from the closest exchange point for each adjacent yarn pair by between 0 and 8 paper side layer weft yarns.

16. A double layer fabric according to claim 1, wherein each exchange point is separated from the closest exchange point for each adjacent yarn pair by 0 paper side layer weft yarns.

17. A double layer fabric according to claim 1, wherein each exchange point is separated from the closest exchange point for each adjacent yarn pair by 2 paper side layer weft yarns.

18. A double layer fabric according to claim 1, wherein each exchange point is separated from the closest exchange point for each adjacent yarn pair by 4 paper side layer weft yarns.

19. A double layer fabric according to claim 1, wherein the warp yarns are constructed of a high modulus polymer material.

20. A double layer fabric according to claim 1, wherein the high modulus polymer material is selected from polyethylene terephthalate (PET), polyethylene naphthalate (PEN) and a para-aramid synthetic fiber.

21. A double layer fabric according to claim 1, wherein the paper side layer weft yarns are constructed of a material selected from PET and a polyamide.

22. A double layer fabric according to claim 1, wherein the machine side layer weft yarns are constructed of a material selected from PET, polybutylene terephthalate (PBT), a polyamide, and a blend of PET and polyurethane.

23. A double layer fabric according to claim 1, wherein the yarns of each set have a cross-sectional configuration selected from substantially circular, ovate, ellipsoid, trapezoidal, rectangular, and square.

* * * * *